US009687053B2

(12) United States Patent
Ko

(10) Patent No.: US 9,687,053 B2
(45) Date of Patent: Jun. 27, 2017

(54) AUTOMATIC UMBRELLA

(71) Applicant: Kwang Joon Ko, Gwangju (KR)

(72) Inventor: Kwang Joon Ko, Gwangju (KR)

( * ) Notice: Subject to any disclaimer, the term of this patent is extended or adjusted under 35 U.S.C. 154(b) by 0 days.

(21) Appl. No.: 15/274,893

(22) Filed: Sep. 23, 2016

(65) Prior Publication Data

US 2017/0099918 A1 Apr. 13, 2017

(30) Foreign Application Priority Data

Oct. 8, 2015 (KR) ..... 10-2015-0141729
Nov. 2, 2015 (KR) ..... 10-2015-0153311
Sep. 22, 2016 (KR) ..... 10-2016-0121507

(51) Int. Cl.
*A45B 25/16* (2006.01)
*A45B 25/14* (2006.01)
(Continued)

(52) U.S. Cl.
CPC ..... *A45B 25/143* (2013.01); *A45B 25/02* (2013.01); *A45B 25/18* (2013.01); *A45B 2025/003* (2013.01); *A45B 2200/1081* (2013.01)

(58) Field of Classification Search
CPC ..... A45B 25/14; A45B 25/143; A45B 25/16; A45B 25/165
See application file for complete search history.

(56) References Cited

U.S. PATENT DOCUMENTS 5,213,122 A * 5/1993 Grady, II ..... A45B 25/165 135/20.3
6,129,101 A * 10/2000 Dubinsky ..... A45B 25/165 135/20.3
(Continued)

FOREIGN PATENT DOCUMENTS

CN 2104571 U * 5/1992
CN 2385577 Y * 5/1992
(Continued)

OTHER PUBLICATIONS

Machine translation of CN 2440359 Y, 8 pages.*
(Continued)

*Primary Examiner* — Robert Canfield
(74) *Attorney, Agent, or Firm* — Lex IP Meister, PLLC

(57) ABSTRACT

Provided is an automatic umbrella including an umbrella shaft which includes a grip portion for allowing a user to grip, at one end according to a longitudinal direction, a plurality of main ribs pivotably coupled with the other end of the umbrella shaft and spaced apart along a circumferential direction of the umbrella shaft, an elevating body slidably installed at the umbrella shaft according to the longitudinal direction, a plurality of sub ribs with both ends pivotably coupled with the main ribs and the elevating body, an umbrella canvas coupled with the main ribs to be supported, and an operation unit which moves the elevating body to the other end of the umbrella shaft to unfold the umbrella shaft when the umbrella shaft tilts to locate the other end to be above the one end of the umbrella shaft and moves the elevating body to the one end of the umbrella shaft to fold the umbrella shaft when the umbrella shaft tilts to locate the one end to be above the other end of the umbrella shaft.

14 Claims, 16 Drawing Sheets

(51) Int. Cl.

| | |
|---|---|
| ***A45B 25/02*** | (2006.01) |
| ***A45B 25/18*** | (2006.01) |
| *A45B 25/00* | (2006.01) |

(56) References Cited

U.S. PATENT DOCUMENTS

| | | | | |
|---|---|---|---|---|
| 8,087,420 | B1 * | 1/2012 | Lukacsy | A45B 23/00 135/20.3 |
| 2012/0266927 | A1 * | 10/2012 | Lukacsy | A45B 23/00 135/20.3 |

FOREIGN PATENT DOCUMENTS

| | | | |
|---|---|---|---|
| CN | 2440359 | Y * | 8/2001 |
| CN | 202698003 | U * | 1/2013 |
| KR | 20-0446344 | | 10/2009 |

OTHER PUBLICATIONS

Machine translation of CN 2104571 U,2 pages.*
Machine translation of CN 202698003 U, 6 pages.*
Machine translation of CN 238557 Y, 5 pages.*

* cited by examiner

AUTOMATIC UMBRELLA

CROSS-REFERENCE TO RELATED APPLICATION

This application claims priority to and the benefit of Korean Patent Application Nos. 10-2015-0141729, filed on Oct. 8, 2015, 10-2015-0153311, filed on Nov. 2, 2015 and 10-2016-0121507, filed on Sep. 22, 2016, the disclosure of which is incorporated herein by reference in its entirety.

BACKGROUND

1. Field of the Invention

The present invention relates to an automatic umbrella, and more particularly, to an automatic umbrella configured to allow umbrella canvas to be automatically folded or unfolded according to a direction in which the umbrella shaft tilts.

2. Discussion of Related Art

Golf is a game of sport in which a golf ball is hit with golf clubs in order to ultimately put the golf ball into a hole formed in a hole area that is away from general hazard areas that are artificially or naturally formed, for example, water, bunkers with sand, wooded areas, etc.

The game of golf described above is one of the outdoor sports requiring carrying an umbrella, together with golf clubs, to avoid sudden showers or strong sunlight while playing on a field. A typical golf umbrella is configured to unfold its umbrella canvas by pushing a button provided at the handle or to fold the umbrella canvas by moving an elevating body provided on the umbrella shaft.

However, when a golf game is played during a shower, it is necessary to manually fold an umbrella to hit a golf ball and then manually unfold the umbrella after hitting the golf ball, and the inconvenience caused by the folding and unfolding of the umbrella causes concentration on the golf game to decrease.

Also, when the umbrella is left without folding the umbrella canvas, the umbrella may fly away.

Also, even for a user who does not play golf, when getting out of rain by coming into a building while carrying luggage on a rainy day, an operation to fold an umbrella to come inside or to unfold an umbrella to go outside is inconvenient. Also, since it is necessary to use both hands when folding or unfolding a conventional umbrella, a disabled person with one arm has trouble using the umbrella.

SUMMARY OF THE INVENTION

The present invention is directed to an automatic umbrella with umbrella canvas automatically folded or unfolded according to a direction in which an umbrella shaft tilts.

According to an aspect of the present invention, there is provided an automatic umbrella including an umbrella shaft which includes a grip portion for allowing a user to grip, at one end according to a longitudinal direction, a plurality of main ribs pivotably coupled with the other end of the umbrella shaft and spaced apart along a circumferential direction of the umbrella shaft, an elevating body slidably installed at the umbrella shaft along the longitudinal direction, a plurality of sub ribs with both ends pivotably coupled with the main ribs and the elevating body, umbrella canvas coupled with the main ribs to be supported, and an operation unit which moves the elevating body to the other end of the umbrella shaft to unfold the umbrella shaft when the umbrella shaft tilts to locate the other end to be above the one end of the umbrella shaft and moves the elevating body to the one end of the umbrella shaft to fold the umbrella shaft when the umbrella shaft tilts to locate the one end to be above the other end of the umbrella shaft.

The operation unit may include a weight portion which is installed at the umbrella shaft to be slidable along the longitudinal direction and has a weight to be moved along a direction in which the umbrella shaft tilts and a driving portion moves the elevating body toward the one end of the umbrella shaft to fold the umbrella shaft when the weight portion becomes adjacent to the other end of the umbrella shaft and moves the elevating body toward the other end of the umbrella shaft when the weight portion is moved toward the one end of the umbrella shaft.

The elevating body may include a restriction groove at an outer circumferential surface, and the driving portion may include a first elastic member which is installed at the umbrella shaft and provides elastic force to move the elevating body toward the other end of the umbrella shaft, restriction protrusions pivotably installed at the one end of the umbrella shaft to be inserted into the restriction groove of the elevating body to restrict the elevating body to the umbrella shaft when the elevating body is positioned at the one end of the umbrella shaft, a restriction control portion which is installed at the one end of the umbrella shaft on a moving path of the weight portion and separates the restriction protrusions from the restriction groove to release a restriction state of the elevating body with the umbrella shaft while being in contact with the weight portion, and an elevating control portion which moves the elevating body toward the one end of the umbrella shaft when the weight portion is separated from the restriction control portion.

The restriction control portion may include a contact panel which is installed at the umbrella shaft on the moving path of the weight portion at a position corresponding to the one end of the umbrella shaft and moves to the one end of the umbrella shaft from the other end when the weight portion collides, a pivoting force transfer portion which is installed between the contact panel and the restriction protrusions and allows the restriction protrusions to pivot to separate the restriction protrusions from the restriction groove of the elevating body when the weight portion collides and the contact panel moves to the one end of the umbrella shaft from the other end, and a second elastic member which provides elastic force to allow the restriction protrusions to protrude outward from an outer circumferential surface of the umbrella shaft to allow the restriction protrusions to enter the restriction groove of the elevating body.

The elevating control portion may include an elevating wire with one end fixed to the elevating body, a winding roller rotatably installed at the one end of the umbrella shaft to allow the other end of the elevating wire to be coupled and winding of the elevating wire, a torque transfer portion which transfers torque of the rotating motor to the winding roller, a battery installed at the umbrella shaft to supply power to the rotating motor, and a control portion which transfers power of the battery to the rotating motor to allow the winding roller to rotate to allow the elevating body to move to the one end of the umbrella shaft when the weight portion is separated from the contact panel and cuts off power supplied to the rotating motor to unwind the elevating wire from the winding roller when the weight portion is in contact with the contact panel.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
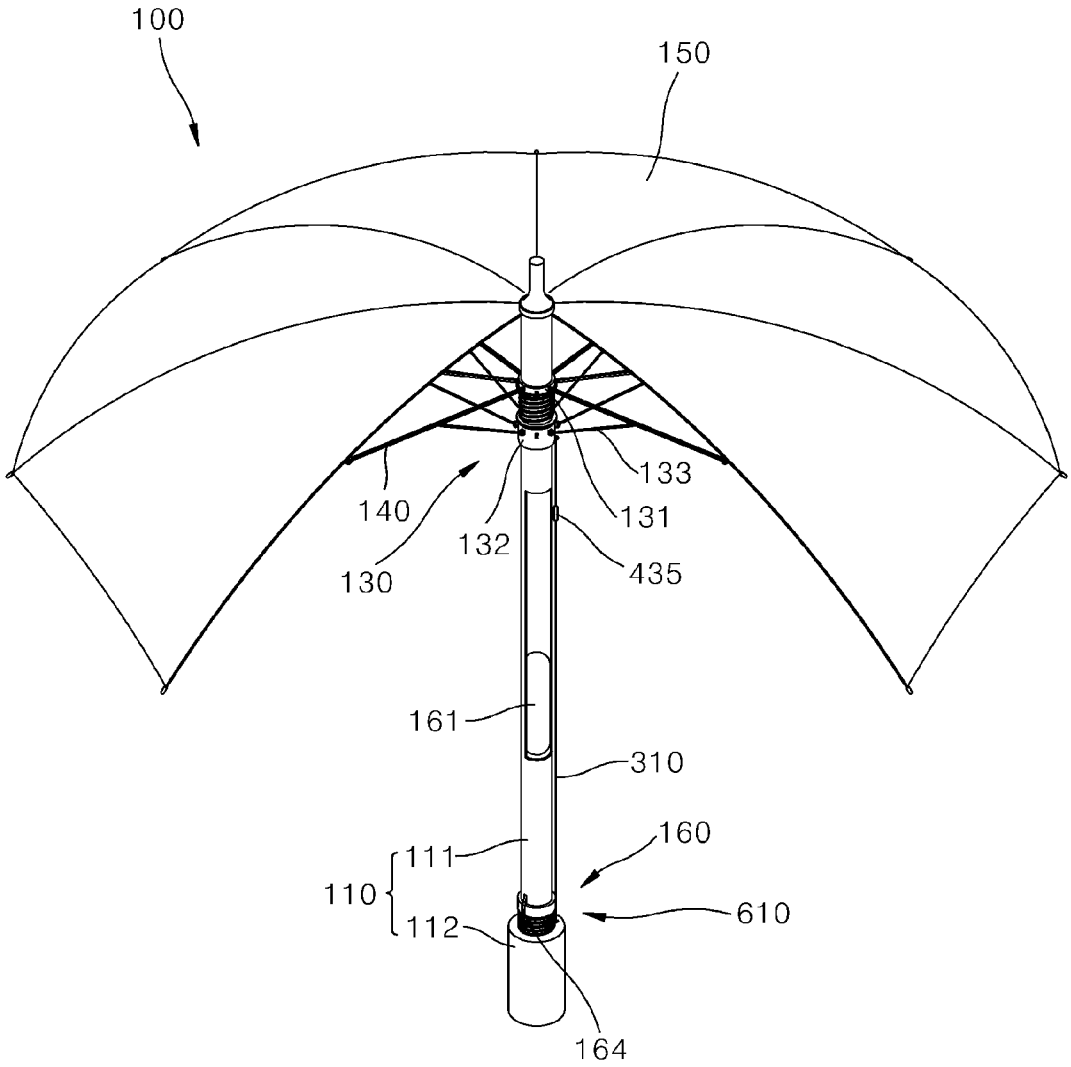
FIG. 1 is a partial exploded perspective view of an automatic umbrella according to one embodiment of the present invention.
Figure 2:
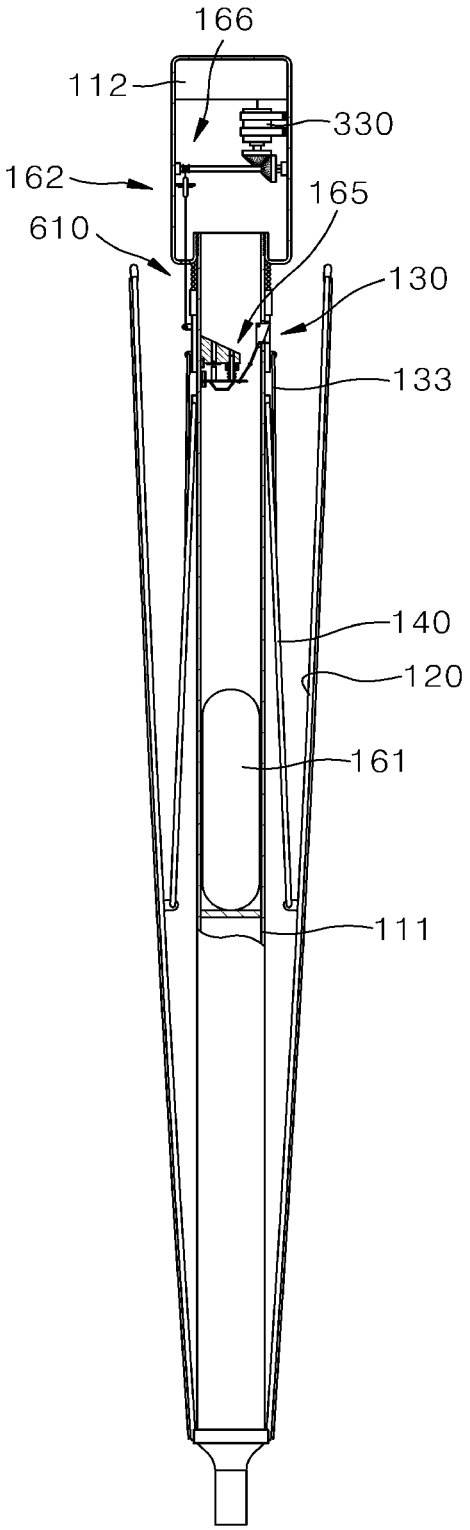
FIG. 2 is a cross-sectional view illustrating a state in which umbrella canvas of the automatic umbrella of FIG. 1 is folded.
Figure 3:
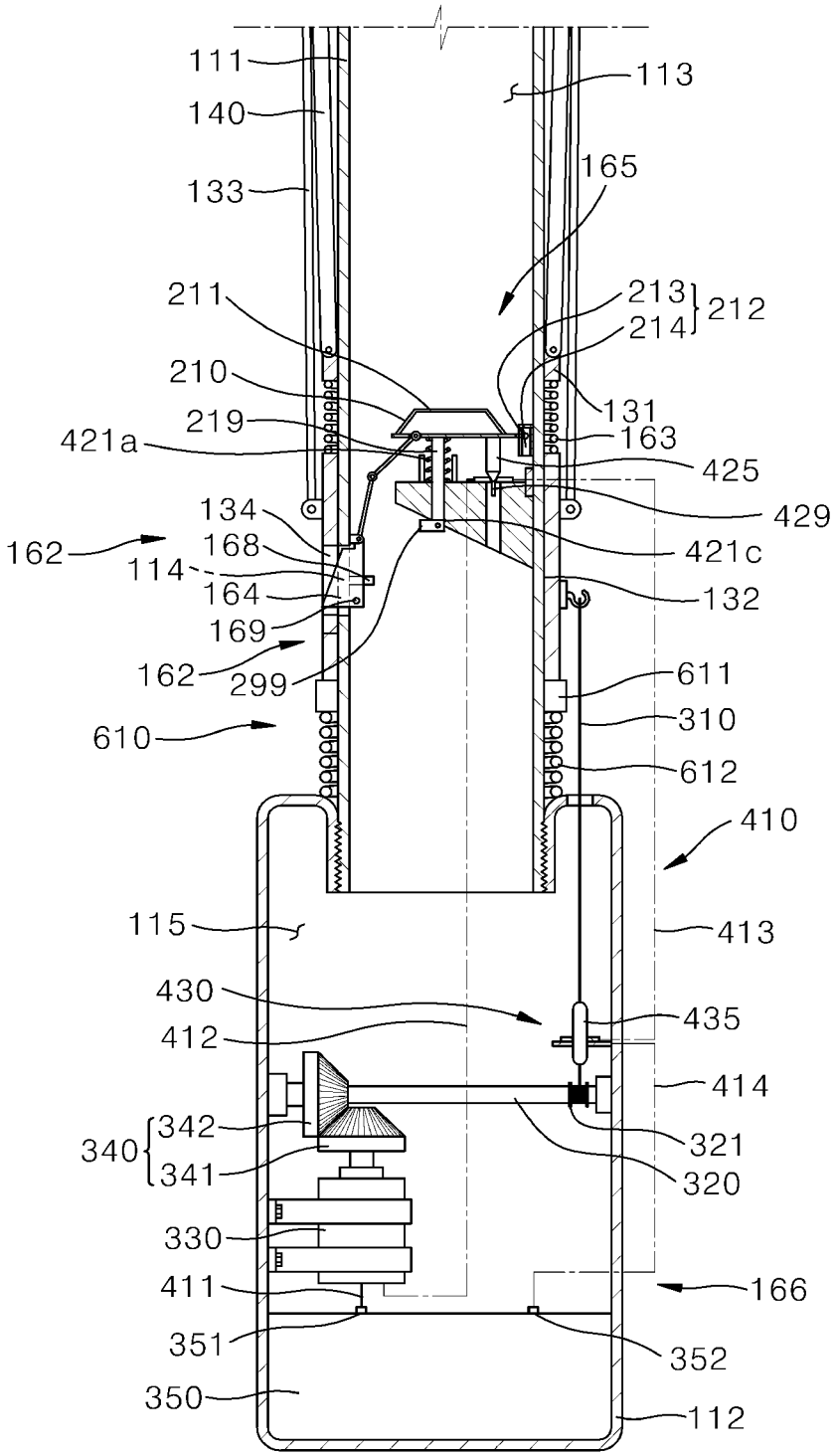
FIG. 3 is a cross-sectional view illustrating a state of an operation unit of the automatic umbrella of FIG. 1 in which the umbrella canvas is folded.
Figure 4:
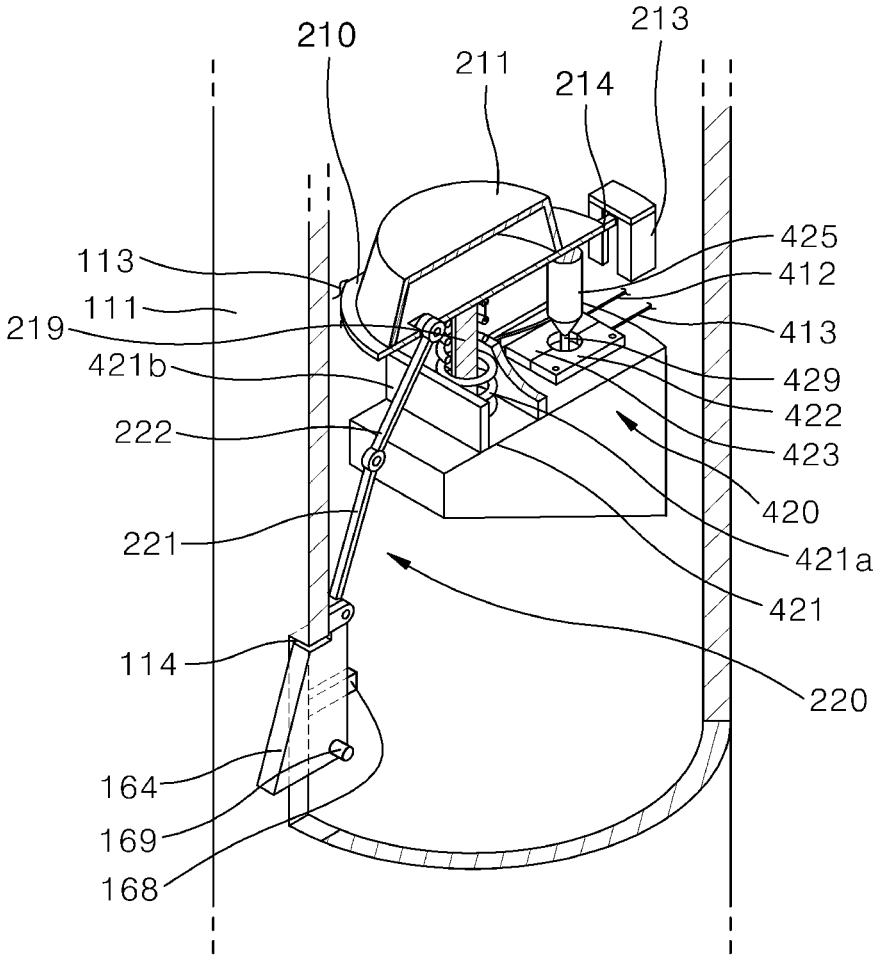
FIG. 4 is a perspective view illustrating a state of a driving portion of the automatic umbrella of FIG. 1 in which the umbrella canvas is folded.
Figure 5:
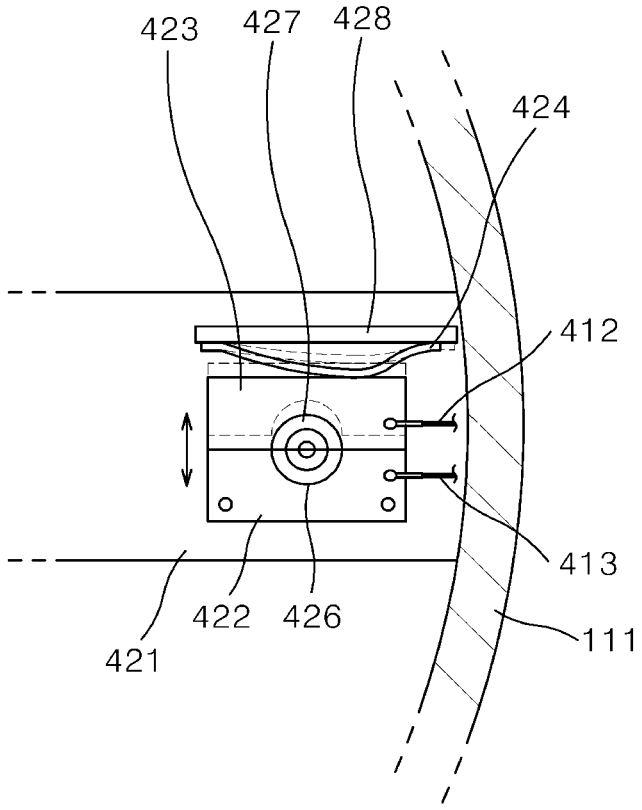
FIG. 5 is a plan view of first and second contact boards of the automatic umbrella of FIG. 1.

Hereinafter, an automatic umbrella according to exemplary embodiments of the present invention will be described with reference to the attached drawings. FIGS. 1 to 11 illustrate an automatic umbrella 100 according to one embodiment of the present invention.

Referring to FIGS. 1 to 11, the automatic umbrella 100 includes an umbrella shaft 110, a main rib 120, an elevating body 130, a sub rib 140, umbrella canvas 150, and an operation unit 160.

The umbrella shaft 110 extends by a certain length, and a grip portion 112 for being gripped by a user is provided at one end.

The umbrella shaft 110 includes a main rod 111 extending by a certain length and the grip portion 112 formed at one end of the main rod 111.

The main rod 111 may include a moving path 113 formed along a longitudinal direction to allow a weight portion 161 of the operation unit 160, which will be described below, to be inserted therein and to move.

The grip portion 112 is formed with an outer diameter greater than an outer diameter of the main rod 111 and includes an internal space 115 connected to the moving path 113 therein.

Also, the grip portion 112 includes an insertion hole 116 formed on a top surface thereof to vertically pass through to allow an elevating wire 310 of the operation unit 160 to be inserted.

Meanwhile, not shown in the drawing, the grip portion 112 may include a plurality of insertion grooves formed on an outer circumferential surface thereof, spaced apart along a vertical direction to correspond to fingers of the user.

The main rib 120 extends to a length for supporting the umbrella canvas 150, and one end thereof is pivotably coupled with another end of the umbrella shaft 110.

A plurality of such main ribs 120 are installed, spaced apart along a circumferential direction of the umbrella shaft 110.

Not shown in the drawing, unlike the embodiment, each of the main ribs 120 may also support quadrangular or triangular umbrella canvas 150 when size and installation position at the umbrella shaft 110 are adjusted.

The elevating body 130 is slidably installed on the outside the umbrella shaft 110 along a longitudinal direction of the umbrella shaft 110.

The elevating body 130 includes an intermediate rib cylinder 131 slidably coupled with the main rod 111 in a longitudinal direction and a lower rib cylinder 132 slidably coupled with the main rod 111 in a longitudinal direction at a position separated from the intermediate rib cylinder 131 and adjacent to the grip portion 112. The intermediate rib cylinder 131 is formed in a cylindrical shape including a first hollow in the center thereof to allow the main rod 111 to pass through, and a plurality of such sub ribs 140 are installed on an outer circumferential surface thereof. One end of the sub rib 140 is pivotably installed at each of the main ribs 120, and another end is pivotably coupled with the outer circumferential surface of the intermediate rib cylinder 131.

The lower rib cylinder 132 is formed in a cylindrical shape including a second hollow in the center thereof to allow the main rod 111 to pass through, and a restriction groove 134 is provided on a lower circumferential surface thereof to allow a restriction protrusion 164 of the operation unit 160, which will be described below, to be inserted.

Also, the lower rib cylinder 132 includes a plurality of supporting ribs 133 installed on an upper outer circumferential surface. One end of the supporting rib 133 is pivotably installed at each of the sub ribs 140, and another end is pivotably coupled with an outer circumferential surface of the lower rib cylinder 132. Meanwhile, in an illustrated example, a structure in which the elevating body 130 includes the intermediate rib cylinder 131 and the lower rib cylinder 132 has been described. However, the elevating body 130 is not limited thereto and may be formed as a single member including a hollow provided in the center to allow the main rod 111 to pass through.

Both ends of the sub rib 140 are pivotably coupled with the main rib 120 and the elevating body 130.

The umbrella canvas 150 is coupled with and supported by the main ribs 120. The umbrella canvas 150 is supported by the main ribs 120 and includes a through hole, formed in the center, corresponding to the outer diameter of the main rod 111 to allow the other end of the main rod 111 to pass through.

Also, a sealing cap is installed at the other end of the main rod 111 to prevent rainwater from flowing into a gap between an inner edge of the umbrella canvas 150 and the main rod 111.

When the umbrella shaft 110 tilts to allow one end of the umbrella shaft 110 to be located above the other end, the operation unit 160 moves the elevating body 130 toward the one end of the umbrella shaft 110 to fold the umbrella canvas 150.

When the umbrella shaft 110 tilts to allow the other end of the umbrella shaft 110 to be located above one end, the operation unit 160 moves the elevating body 130 toward the other end of the umbrella shaft 110 to unfold the umbrella canvas 150.

The operation unit 160 includes the weight portion 161 and a driving portion 162.

The weight portion 161 has optimal weight to be moved along a direction in which the umbrella shaft 110 tilts and is installed to be slidable along the longitudinal direction of the umbrella shaft 110.

The weight portion 161 is slidably installed in the moving path 113 of the main rod 111 along a longitudinal direction of the main rod 111. The weight portion 161 may be formed of a metallic material having optimal weight.

The driving portion 162 moves the elevating body 130 toward the one end of the umbrella shaft 110 to fold the umbrella canvas 150 when the weight portion 161 becomes adjacent to the other end of the umbrella shaft 110 and, when the weight portion 161 moves toward the one end of the umbrella shaft 110, moves the elevating body 130 toward the other end of the umbrella shaft 110.

The driving portion 162 includes a first elastic member 163, the restriction protrusion 164, a restriction control portion 165, and an elevating control portion 166.

The first elastic member 163 is installed at the umbrella shaft 110 and provides elastic force to allow the elevating body 130 to move toward the other end of the umbrella shaft 110.

A coil spring with one end fixed to the intermediate rib cylinder 131 and the other end fixed to the lower rib cylinder 132 is applied as the first elastic member 163.

The first elastic member 163 provides an elastic force in a direction in which the intermediate rib cylinder 131 may become farther away from the lower rib cylinder 132. When the elevating body 130 is located at one end of the umbrella shaft 110 and is restricted by the restriction protrusion 164, the first elastic member 163 is compressed by the intermediate rib cylinder 131 and the lower rib cylinder 132. When the elevating body 130 is released from a restriction state with the umbrella shaft 110, the intermediate rib cylinder 131 moves toward the other end of the umbrella shaft 110 by the elastic force of the first elastic member 163 and the sub rib 140 and the main rib 120 are unfolded by the supporting rib 133. Here, the lower rib cylinder 132 and the intermediate rib cylinder 131 are moved together by the supporting rib 133 toward the other end of the umbrella shaft 110.

Meanwhile, not shown in the drawing, when the elevating body 130 is formed as a single member, the first elastic member 163 is installed to allow both ends thereof to be fixed to the other end of the main rod 111 and the elevating body 130 to provide elastic force for moving the elevating body 130 toward the other end of the main rod 111.

The restriction protrusion 164 is pivotably installed at one end of the umbrella shaft 110 to be inserted into restriction groove 134 of the elevating body 130 to restrict the elevating body 130 at the umbrella shaft 110, when the elevating body 130 is positioned at the one end of the umbrella shaft 110.

One end of the restriction protrusion 164 is pivotably coupled with the main rod 111, and the other end is installed to protrude outside the main rod 111 through a through groove 114 formed at an outer circumferential surface of one end of the main rod 111.

The restriction protrusion 164 may be installed at the main rod 111 to pivot around a virtual rotational center line intersecting the longitudinal direction of the main rod 111 and may be formed to allow increasing width from one end to the other end.

Meanwhile, an interference protrusion 169 is formed at a side of the restriction protrusion 164 to restrict protruding length of the restriction protrusion 164 toward the main rod 111, when the other end of the restriction protrusion 164 protrudes outside the main rod 111 through the through groove 114.

The interference protrusion 169 is formed at the restriction protrusion 164 on a side adjacent to a center line in the longitudinal direction of the moving path 113 and protrudes in a longitudinal direction of the rotation-center line of the restriction protrusion 164 to interfere with an inner wall of the main rod 111.

Meanwhile, the main rod 111 includes a plurality of guide protrusions 168 which protrude inside the main rod 111 from left and right edges of the through groove 114 to guide the restriction protrusion 164 when the restriction protrusion 164 pivots toward inside of the main rod 111.

The restriction control portion 165 is installed on the moving path of the weight portion 161 at a position corresponding to the one end of the umbrella shaft 110 to separate the restriction protrusion 164 from the restriction groove 134 of the elevating body 130 to release the restriction state of the elevating body 130 with the umbrella shaft 110 when the weight portion 161 comes into contact.

The restriction control portion 165 includes a contact panel 210, a pivoting force transfer portion 220, and a second elastic member 421*a*.

The contact panel 210 is installed at the umbrella shaft 110 to be moved in a direction of the umbrella shaft 110 toward the one end from the other end, when the weight portion 161 collides.

The contact panel 210 is slidably installed along the longitudinal direction of the main rod 111 by a guide unit 212 in the moving path 113 at a position separate from the restriction protrusion 164 toward the other end of the main rod 111.

The contact panel 210 has a structure in which a panel-shaped portion formed in a panel shape and a protrusion portion 211 which protrudes from the center of the panel-shaped portion toward the other end of the main rod 111 are formed.

Also, the contact panel 210 includes an inducing protrusion 219 extending toward one end of the main rod 111 at a bottom surface opposite to the second elastic member 421*a*. The inducing protrusion 219 is formed at the contact panel 210 at a position opposite to an inducing groove 421*c* of a first fixed plate 421 and extends toward the one end of the umbrella shaft 110 from the contact panel 210 to allow an end thereof to pass through the second elastic member 421*a* and be inserted into the inducing groove 421*c* of the first fixed plate 421.

Here, the inducing protrusion 219 may extend longer than a sum length of a movement distance of the contact panel 210 and a length of the inducing groove 421*c* to allow the end to pass through the first fixed plate 421 and protrude.

Meanwhile, a separation-preventing protrusion 299 formed to be bent against the inducing protrusion 219 is formed at the end of the inducing protrusion 219 to prevent the inducing protrusion 219 from being separated from the first fixed plate 421 when the contact panel 210 moves from the first fixed plate 421 to the other end of the umbrella shaft 110.

The guide unit 212 includes a rail 213 which is installed on the inside wall of the main rod 111 opposite to the contact panel 210 and extends in the longitudinal direction of the main rod 111 and a moving member 214 which is fixed to an edge of the contact panel 210 and moves along the rail 213 in the longitudinal direction of the main rod 111. Here, an upper end of the rail 213 may be closed to prevent the moving member 214 from being separated.

One end of the moving member 214 is fixed to one end of the contact panel 210 opposite to the rail 213, and the other end is inserted in the rail 213 and installed to be movable along the rail 213.

The contact panel 210 is supported by the guide unit 212 described above to be slidable along the longitudinal direction of the main rod 111.

One end of the auxiliary spring is fixed to the moving member 214 and the other end is fixed to an end of the rail 213, and meanwhile, not shown in the drawing, the guide unit 212 includes an auxiliary spring which is installed at the moving member 214 and provides elastic force to move the moving member 214 toward the other end of the main rod 111. When the weight portion 161 is separated from the contact panel 210, the auxiliary spring provides the elastic force to the moving member 214 to move the contact panel 210 to the other end of the main rod 111.

The pivoting force transfer portion 220 is installed between the contact panel 210 and the restriction protrusion 164 and rotates the restriction protrusion 164 to separate the restriction protrusion 164 from the restriction groove 134 when the weight portion 161 collides and the contact panel 210 moves to the one end of the umbrella shaft 110 from the other end.

The pivoting force transfer portion 220 includes a first link 221 with one end fixed to the restriction protrusion 164 and a second link 222 with one end pivotably installed at the other end of the first link 221 and the other end pivotably installed at the contact panel 210. The first link 221 extends by a certain length from the rotation center line of the restriction protrusion 164 toward the contact panel 210. Also, the other end of the second link 222 may be pivotably installed on the contact panel 210 at a position separated from the edge of the contact panel 210 to the inside wall of the main rod 111 to be interfered by the contact panel 210 and restricted in pivoting angle.

The second elastic member 421*a* provides elastic force to the restriction protrusion 164 to protrude outside from an outer circumferential surface of the umbrella shaft 110 to allow the restriction protrusion 164 to be inserted into the restriction groove 134 of the elevating body 130.

The second elastic member 421*a* is installed between the first fixed plate 421 of a first switching portion 420 and the contact panel 210 of the restriction control portion 165 and provides elastic force to separate the contact panel 210 from the first fixed plate 421. Here, the second elastic member 421*a* may be a spirally wound coil spring.

When the weight portion 161 collides with the protrusion portion 211 of the contact panel 210, the contact panel 210 is moved closer to the grip portion 112. Here, the contact panel 210 allows the first link 221 to pivot in a direction of becoming closer to an inside surface of the main rod 111 using the second link 222. The other end of the restriction protrusion 164 is inserted inside the main rod 111 and pivots due to pivoting of the first link 221 and is separated from the restriction groove 134 of the elevating body 130. Meanwhile, when the weight portion 161 is separated from the contact panel 210, the first link 221 pivots in a direction of getting far away from the inner surface of the main rod 111 due to elastic force of the second elastic member 421*a*. Here, the other end of the restriction protrusion 164 pivots to protrude outside the main rod 111 due to the first link 221 and the contact panel 210 is moved toward the other end of the main rod 111.

The elevating control portion 166 moves the elevating body 130 toward the one end of the umbrella shaft 110 when the weight portion 161 is separated from the restriction control portion 165.

The elevating control portion 166 includes an elevating wire 310, a winding roller 320, a rotating motor 330, a torque transfer portion 340, a battery 350, and a controller portion.

One end of the elevating wire 310 is fixed to the elevating body 130, and the other end is fixed to the winding roller 320.

That is, the one end of the elevating wire 310 is fixed and hooked by a fixed hook fixed to the outer circumferential surface of the lower rib cylinder 132, and the other end is inserted into the internal space 115 of the grip portion 112 through the insertion hole 116 formed in the top surface of the grip portion 112 and fixed to the winding roller 320.

The winding roller 320 may be rotatably installed at the one end of the umbrella shaft 110 for winding the other end of the elevating wire 310.

The winding roller 320 is installed in the grip portion 112 opposite to the insertion hole 116, and both ends thereof are rotatably supported by an inside surface of the grip portion 112. Also, the winding roller 320 may include a plurality of separation-preventing plates 321 spaced apart in a longitudinal direction to prevent the wound elevating wire 310 from being separated, on one end thereof. The separation-preventing plate 321 is formed with an outer diameter greater than the outer diameter of the winding roller 320.

The rotating motor 330 is installed at the umbrella shaft 110 and generates torque.

The rotating motor 330 is installed inside the grip portion 112, receives power from the battery 350 to generate torque.

The torque transfer portion 340 is installed between the winding roller 320 and the rotating motor 330 and transfers torque of the rotating motor 330 to the winding roller 320.

The torque transfer portion 340 includes a first bevel gear 341 installed at the rotation shaft of the rotating motor 330 and a second bevel gear 342 installed at the other end of the winding roller 320 and engaged with the first bevel gear 341. Meanwhile, not shown in the drawing, the rotating motor 330 may be directly installed at the rotation shaft and may rotate the winding roller 320. That is, the rotating motor 330 may be installed at the grip portion 112 to be parallel to a longitudinal direction of the winding roller 320.

Also, a clutch portion (not shown) is installed between the rotating motor 330 and the winding roller 320 to apply the torque of the rotating motor 330 is applied to the winding roller 320 when the rotating motor 330 is winding the elevating wire 310 and to allow the winding roller 320 to idle in an idle state with respect to the rotating motor 330 when the elevating wire 310 is unwinding in a direction of being unwound from the winding roller 320.

The battery 350 is installed at the umbrella shaft 110 to supply power to the rotating motor 330.

The battery 350 is installed inside the grip portion 112 and supplies power to the rotating motor 330 by the controller portion which will be described below. A battery or a battery charger is applied to the battery 350. Here, not shown in the drawing, the grip portion 112 has an open bottom to easily replace the battery 350, and a cover is detachably installed at the grip portion to open and close the open bottom.

The controller portion transfers the power of the battery 350 to the rotating motor 330 to rotate the winding roller 320 to move the elevating body 130 toward the one end of the umbrella shaft 110 when the weight portion 161 is separated from the contact panel 210 and cuts off power supplied to the rotating motor 330 and allows the elevating wire 310 to unwind from the winding roller 320 when the weight portion 161 is in contact with the contact panel 210.

The controller portion includes a power line 410, the first switching portion 420, and a second switching portion 430.

The power line 410 is installed between the rotating motor 330 and the battery 350 to be connected to the first switching portion 420 in series through the second switching portion 430 and wired to supply the power of the battery 350 to the rotating motor 330.

The power line 410 is connected in series on a power supply path for supplying the power from the battery 350 to the rotating motor 330.

The power line 410 includes a main line 411 which connects a first pole 351 of both poles of the battery 350 with a corresponding pole of the rotating motor 330, a first sub line 414 which connects a second pole 352 of the battery 350 with the second switching portion 430, a second sub line 413 which connects the second switching portion 430 with the first switching portion 420, and a third sub line 412 which connects the first switching portion 420 with another pole of the rotating motor 330.

The first switching portion 420 is interconnected with the contact panel 210 and cuts off power supplied through the power line 410 when the contact panel 210 moves toward the one end of the umbrella shaft 110 due to a collision with the weight portion 161.

The first switching portion 420 includes the first fixed plate 421, first and second contact plates 422 and 423, a third elastic member 424, and an interconnection protrusion 425.

The first fixed plate 421 is fixed to a position of the umbrella shaft 110 which is displaced toward the one end from the other end of the umbrella shaft 110, against the other surface of the contact panel 210 opposite to one surface of the contact panel 210 which faces the weight portion.

The first fixed plate 421 is formed in a plate shape which protrudes from the inside wall of the main rod 111 toward the center of the moving path 113 and has a certain thickness.

The first fixed plate 421 includes an inlet vertically pierced to allow an end of the interconnection protrusion 425 to be inserted therein at a position which faces the interconnection protrusion 425.

The first fixed plate 421 is formed as an insulator to prevent conduction. Meanwhile, the second elastic member 421*a* is fixed to the other surface of the first fixed plate 421 at a position separated from the inlet. One end of the second elastic member 421*a* is fixed to the first fixed plate 421, and the other end is fixed to the contact panel 210 and provides elastic force in a direction in which the contact panel 210 is separated from the first fixed plate 421. The second elastic member 421*a* provides elastic force to the contact panel 210 to allow the contact panel 210 to return to an initial position when the weight portion 161 is separated from the contact panel 210.

Also, the inducing groove 421*c* is formed at the first fixed plate 421 to allow the inducing protrusion 219 to be inserted therein. Since the inducing protrusion 219 is inserted in the inducing groove 421*c* and movement of the contact panel 210 is guided, the contact panel 210 is prevented from being distorted while moving.

Thickness of the first fixed plate 421 may increase with getting closer to the inner wall of the main rod 111 to strongly support the contact panel 210 and the first switching portion 420.

Also, a plurality of restriction protrusions 421*b* are installed on the first fixed plate 421 at mutually opposite positions based on the second elastic member 421*a*. The restriction protrusion 421*b* protrudes in a direction of getting closer to the contact panel 210 to limit a movement distance of the contact panel 210. When the contact panel 210 moves due to a collision with the weight portion 161, the contact panel 210 is prevented by the restriction protrusions 421*b* from colliding with the first fixed plate 421.

The first and second contact plates 422 and 423 are installed at positions of the first fixed plate 421 facing the other surface of the contact panel 210, to be capable of combining or separating.

When the first and second contact plates 422 and 423 are coupled with each other, the second sub line 413 and the third sub line 412 are connected to each other. When the first and second contact plates 422 and 423 are separated from each other, the second sub line 413 and the third sub line 412 are separated from each other. The first and second contact plates 422 and 423 are installed at positions opposite each other, on one surface of the first fixed plate 421, based on the center of the inlet. Here, the first contact plate 422 is fixed to the first fixed plate 421, and the second contact plate 423 is installed to be slidable in a direction of separating from or getting closer to the first contact plate 422.

The first contact plate 422 includes a hemispherical first connection hole 426 formed at an edge of one side facing the inlet to be connected to the inlet. Here, the first contact plate 422 is connected to the second sub line 413 and is formed as a conductor which can conduct electricity. Also, the first connection hole 426 is formed with an inside diameter smaller than the outside diameter of the interconnection protrusion 425.

The second contact plate 423 includes a hemispherical second connection hole 427 formed at an edge of one side facing the first connection hole 426.

When the second contact plate 423 is coupled with the first contact plate 422, the first and second connection holes 426 and 427 are coupled with each other and form a first insertion path in which the interconnection protrusion 425 is inserted. Here, the second connection hole 427 may be formed with an inner diameter smaller than the outer diameter of the interconnection protrusion 425 to separate the first and second contact plates 422 and 423 from each other, when the interconnection protrusion 425 is inserted in the first insertion path.

Here, the second contact plate 423 is connected to the third sub line 412 and is formed as a conductor which conducts electricity. Meanwhile, not shown in the drawing, the second contact plate 423 includes an insertion protrusion which is formed on a side facing the first fixed plate 421 and protrudes toward the first fixed plate 421, and the first fixed plate 421 includes a first guide groove formed to allow the insertion protrusion to be inserted. Here, the first guide groove may extend by a certain length along a movement path of the second contact plate 423.

Meanwhile, the first connection hole 426 and the second connection hole 427 are formed having tapered edges of one sides facing the contact panel 210 to allow the interconnection protrusion 425 to be easily inserted.

The third elastic member 424 provides elastic force in a direction in which the first and second contact plates 422 and 423 are coupled with each other.

The interconnection protrusion 425 is formed as an insulator and fixed to the other surface of the contact panel 210 at a position facing contact surfaces of the first and second contact plates 422 and 423.

The interconnection protrusion 425 is inserted into a gap between the first and second contact plates 422 and 423 and separates the first and second contact plates 422 and 423 from each other to cut off power supplied to the rotating motor 330 when the contact panel 210 moves due to colliding with the weight portion 161.

The interconnection protrusion 425 protrudes from the contact panel 210 toward the first fixed plate 421, and an end thereof is formed with decreasing outer diameter with getting closer to the first fixed plate 421 to be easily inserted into the first connection hole 426 and the second connection hole 427. Also, a guide protrusion 429 is formed at an end of the interconnection protrusion 425 to guide the interconnection protrusion 425 to be inserted into the gap between the first and second contact plates 422 and 423.

The guide protrusion 429 protrudes from the end of the interconnection protrusion 425 in a direction of getting closer to the first fixed plate 421 and is inserted into the inlet of the first fixed plate 421. The guide protrusion 429 is formed with an outer diameter smaller than the inner diameter of the first insertion path formed when the first and second connection holes 426 and 427 are coupled with each other.

Figure 6:
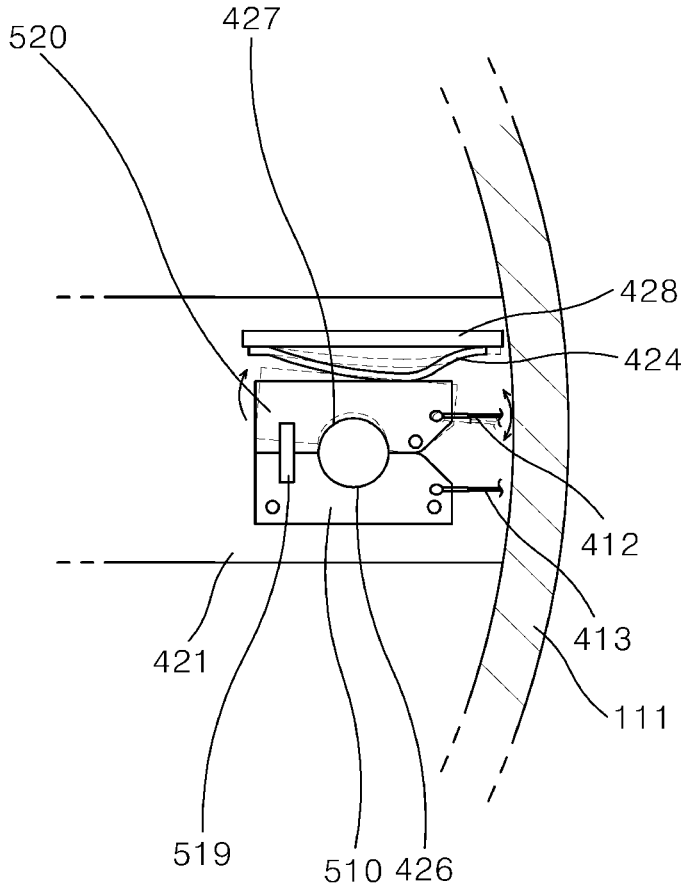
FIG. 6 is a plan view of first and second contact boards according to another embodiment of the present invention.

Meanwhile, FIG. 6 illustrates a first contact plate 510 and a second contact plate 520 according to another embodiment of the present invention. Elements which perform the same function as shown in the previous drawings will be referred by the same reference numerals.

Referring to FIG. 6, the first contact plate 510 is fixed to the first fixed plate 421, and the second contact plate 520 is installed at the first fixed plate 421 to allow one end adjacent to the inner surface of the main rod 111 to be pivotable. Also, the first and second contact plates 510 and 520 are processed to allow edges of one side adjacent to the inner surface of the main rod 111 to be beveled to prevent interference while pivoting.

Also, a first interference member 519 is installed at the other end of the first contact plate 510 to prevent the second contact plate 520 from being separated from the first fixed plate 421. One end of the first interference member 519 is fixed to a top surface of the other end of the first contact plate 510, and the other end extends toward the second contact plate 520.

Here, the first contact plate 510 includes an insulating coating layer (not shown) which is formed to prevent an area from the first connection hole 426 to one end of a side facing the second contact plate 520 from conducting electricity. Here, the second contact plate 520 includes an insulating coating layer (not shown) which is formed to prevent an area from the second connection hole 427 to one end of a side facing the first contact plate 510 from conducting electricity.

Meanwhile, the third elastic member 424 is installed at a first supporting plate 428 fixed to the first fixed plate 421 at a separated position in a direction of getting far away from the second contact plate 423 and may be a plate spring that is convex toward the second contact plate 423. One end of the third elastic member 424 is fixed to the first supporting plate 428, and the other end is movably coupled with the first supporting plate 428.

When the interconnection protrusion 425 is inserted between the first and second contact plates 422 and 423, the second contact plate 423 is separated from the first contact plate 422 and the third elastic member 424 is distorted by the second contact plate 423 which is moving and provides elastic force to the second contact plate 423 to allow the second contact plate 423 to be in contact with the first contact plate 422 when the interconnection protrusion 425 is separated from the first and second contact plates 422 and 423.

The second switching portion 430 is connected to the first switching portion 420 in series on a power supply path which supplies power from the battery 350 to the rotating motor 330 and opens the power supply path to prevent supplying power to the rotating motor 330, when the restriction protrusion 164 is inserted into the restriction groove 134 of the elevating body 130 and the elevating body 130 is restricted by the umbrella shaft 110.

Figure 7:
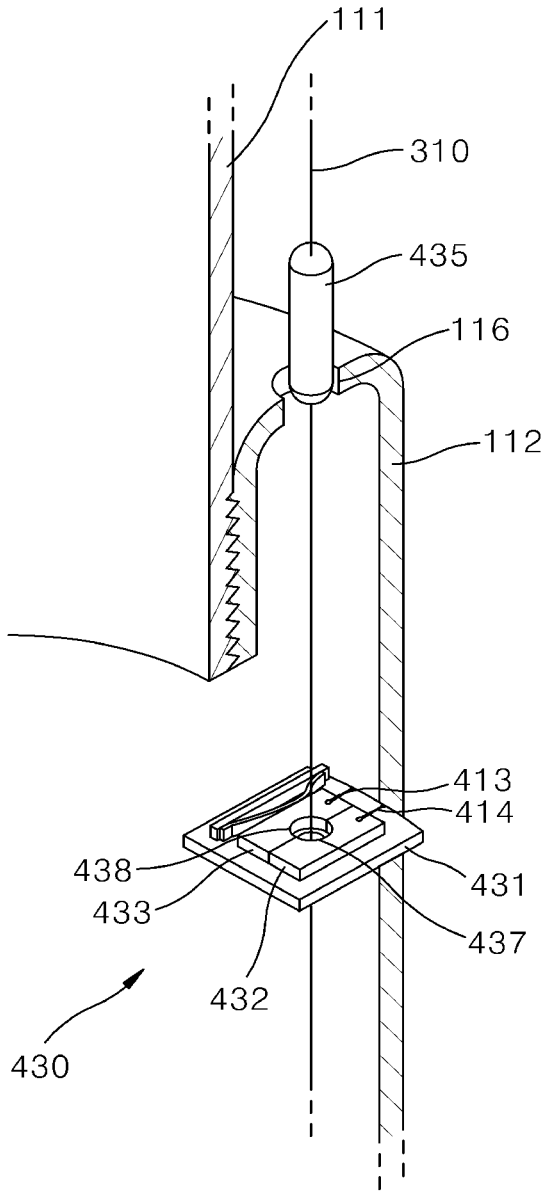
FIG. 7 is a perspective view of third and fourth contact boards of the automatic umbrella of FIG. 1.
Figure 8:
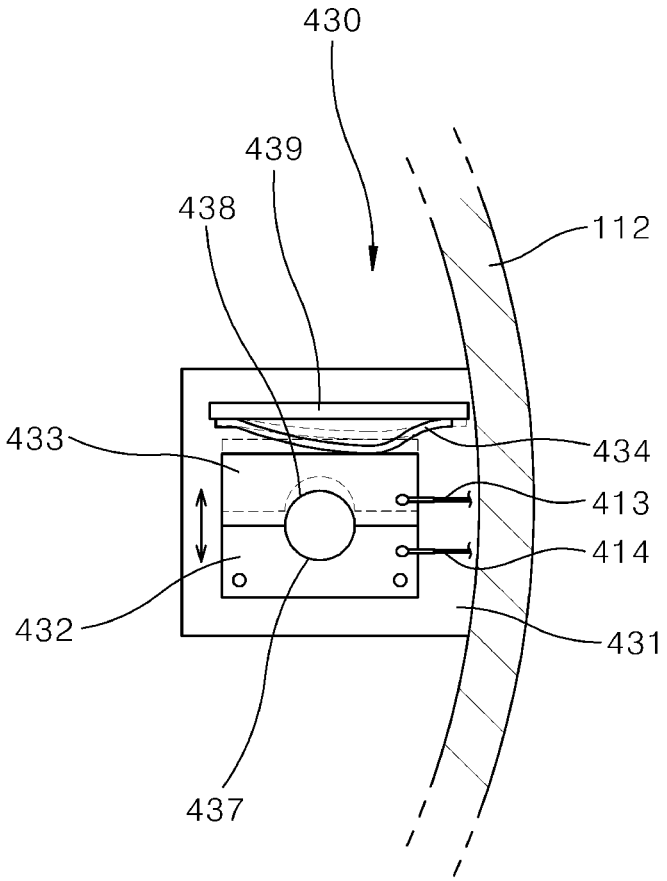
FIG. 8 is a plan view of the third and fourth contact boards of the automatic umbrella of FIG. 1.

The second switching portion 430 will be described with reference to FIGS. 7 and 8.

The second switching portion 430 includes a second fixed plate 431 which is installed at the umbrella shaft 110 and includes a through hole to allow the elevating wire 310 to pass through, third and fourth contact plates 432 and 433 which are installed at the second fixed plate 431 to be adjacent to or separated from each other based on the elevating wire 310, connected to the power line 410 to supply the power of the battery 350 to the rotating motor 330 through the power line 410 while being in contact with each other, and prevent supplying power through the power line 410 while being separated from each other, a fourth elastic member 434 which provides elastic force to allow the third and fourth contact plates 432 and 433 to be coupled with each other, and a separation member 435 which is fixed to the elevating wire 310, is inserted in between the third and fourth contact plates 432 and 433 to separate the third and fourth contact plates 432 and 433 from each other when the elevating body 130 moves to the one end of the umbrella shaft 110 to allow the restriction protrusion 164 to be inserted into the restriction groove 134.

The second fixed plate 431 is installed inside the grip portion 112 between the insertion hole 116 of the grip portion 112 and the winding roller 320.

One end of the second fixed plate 431 is fixed to the inner surface of the grip portion 112, and the other end protrudes toward the center of the internal space 115. The second fixed plate 431 includes a through hole formed at a position facing the insertion hole 116.

The third and fourth contact plates 432 and 433 are installed at positions opposite each other, on one surface of the second fixed plate 431, based on the center of the through hole. The third contact plate 432 is fixed to the second fixed plate 431, and the fourth contact plate 433 is installed to be slidable in a direction of separating from or getting closes to the third contact plate 432.

The third contact plate 432 includes a hemispherical third connection hole 437 formed at an edge of one side opposite to the through hole to be connected to the through hole. Here, the third contact plate 432 is connected to the first sub line 414 and is formed as a conductor which conducts electricity. Also, the third connection hole 437 may be formed with an inner diameter smaller than the outer diameter of the separation member 435.

The fourth contact plate 433 includes a hemispherical fourth connection hole 438 formed at an edge of one side facing the third connection hole 437. When the fourth contact plate 433 is coupled with the third contact plate 432, the third and fourth connection holes 437 and 438 are coupled with each other and form a second insertion path into which the separation member 435 is inserted. Here, the fourth connection hole 438 may be formed with an inner diameter smaller than the outer diameter of the separation member 435 to separate the third and fourth contact plates 432 and 433 from each other when the separation member 435 is inserted in the second insertion path.

The fourth contact plate 433 is connected to the second sub line 413 and is formed as a conductor which conducts electricity. Meanwhile, not shown in the drawing, the fourth contact plate 433 includes a second inducing protrusion which is formed on a side facing the second fixed plate 431 and protrudes toward the first fixed plate 421, and the second fixed plate 431 includes a second guide groove formed to allow the second inducing protrusion to be inserted. Here, the second guide groove may extend by a certain length along a movement path of the fourth contact plate 433.

Also, the third connection hole 437 and the fourth connection hole 438 are formed having tapered edges on one side facing the insertion hole 116 to allow the separation member 435 to be easily inserted.

Figure 9:
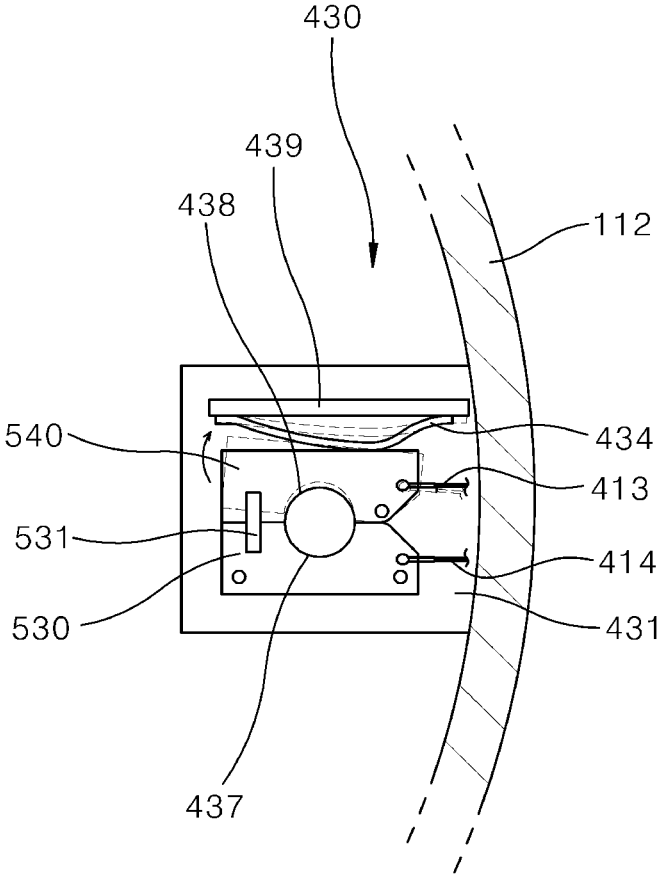
FIG. 9 is a plan view of third and fourth contact boards according to another embodiment of the present invention.
Figure 10:
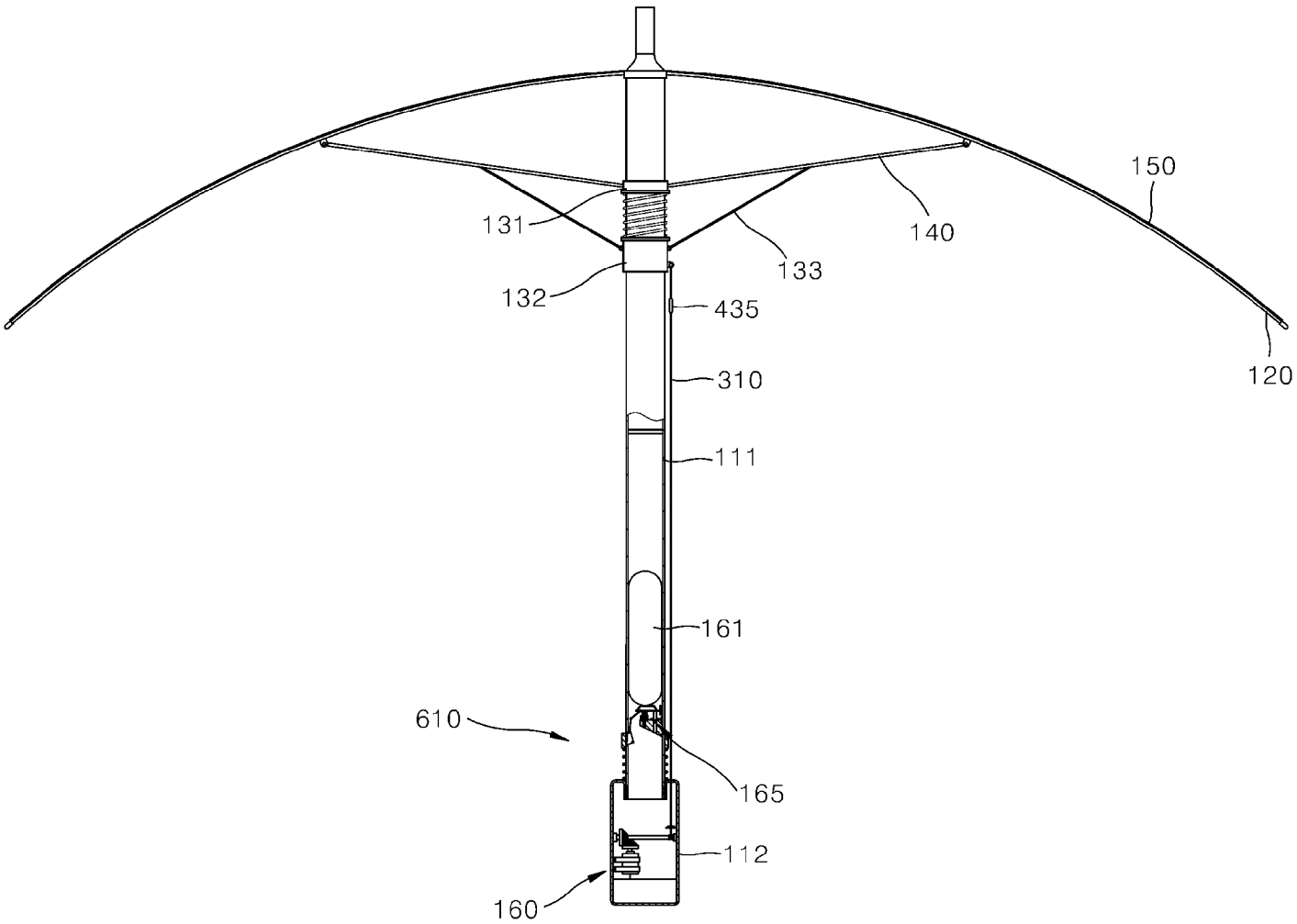
FIG. 10 is a cross-sectional view illustrating a state in which the umbrella canvas of the automatic umbrella of FIG. 1 is unfolded.
Figure 11:
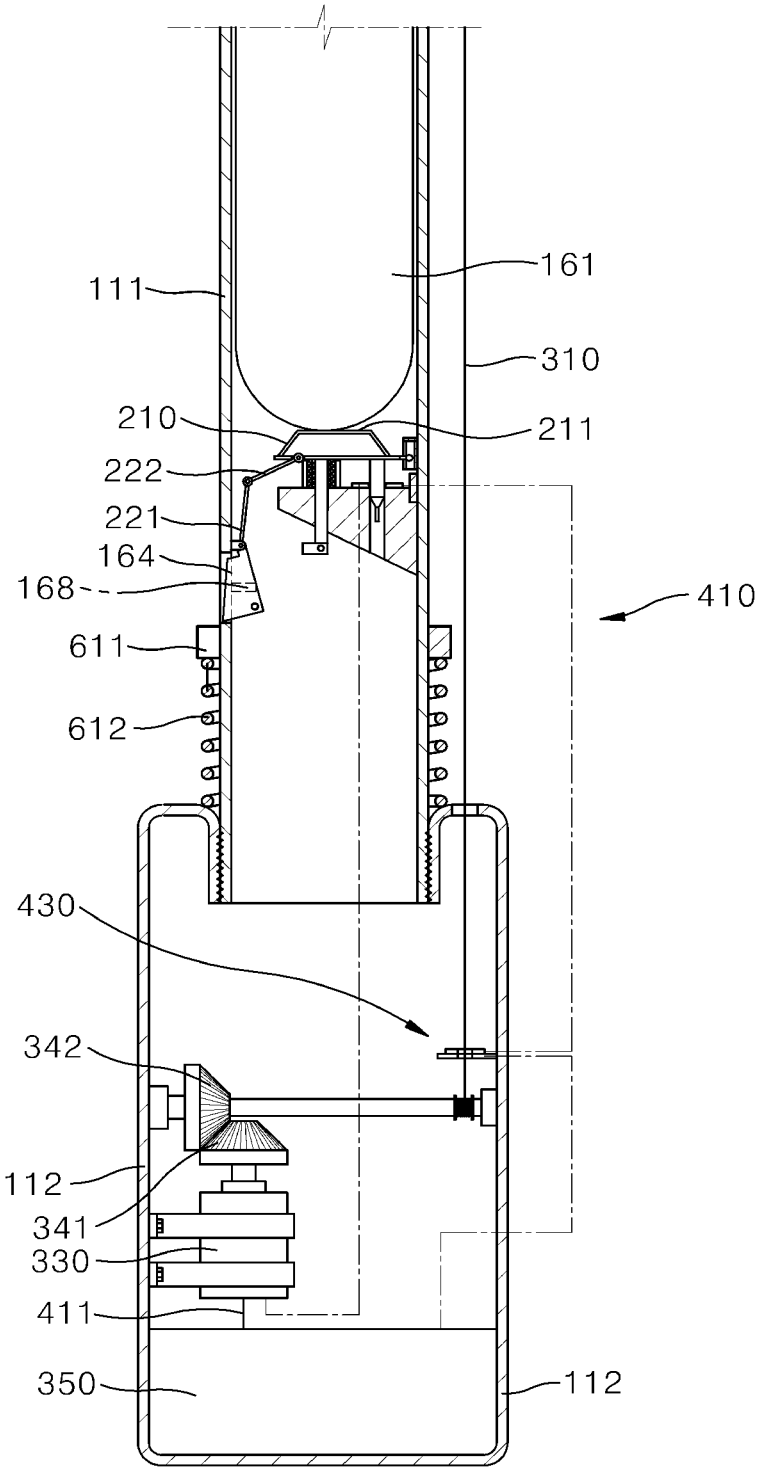
FIG. 11 is a cross-sectional view illustrating a state of an operation unit of the automatic umbrella of FIG. 1 in which the umbrella canvas is unfolded.
Figure 12:
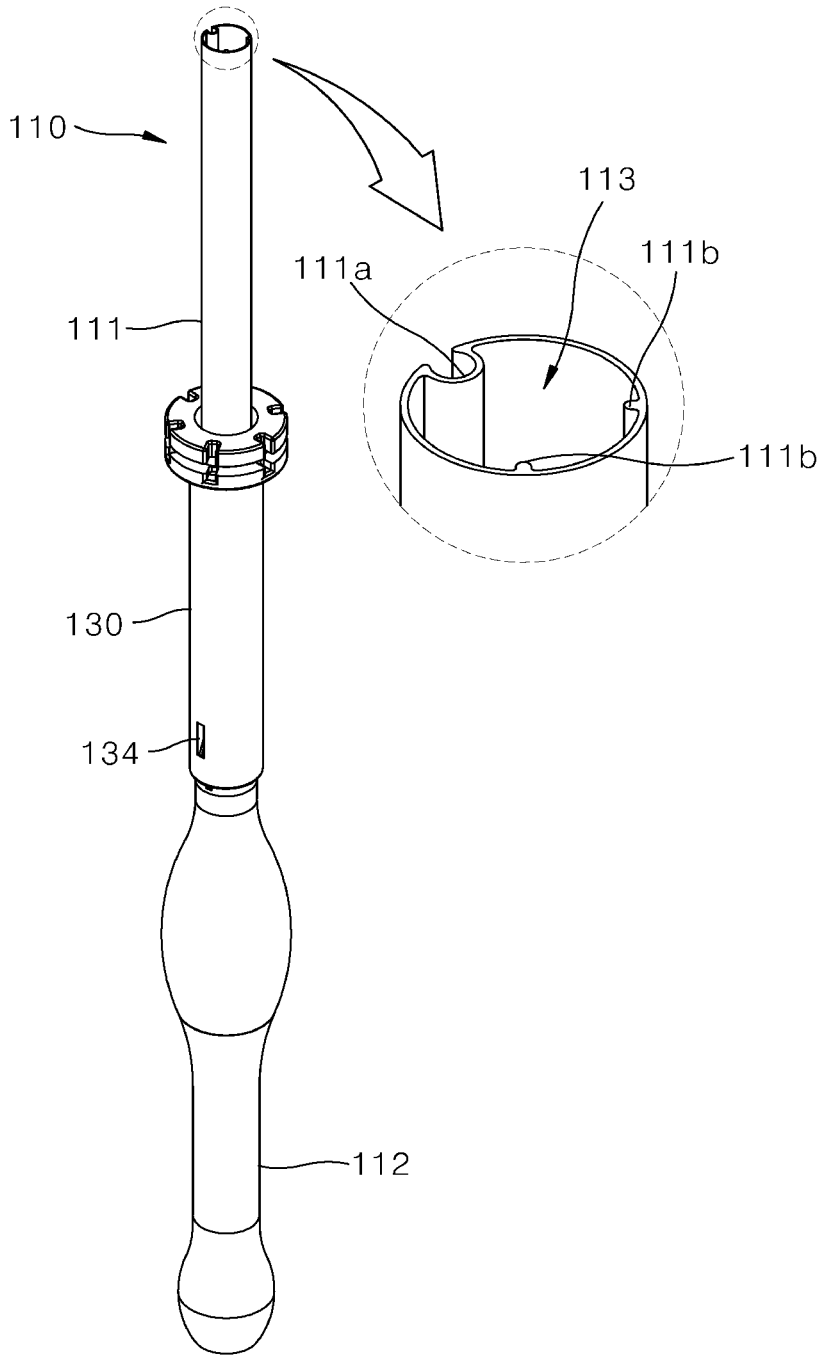
FIG. 12 is a perspective view illustrating a part of an automatic umbrella according to another embodiment of the present invention.
Figure 13:
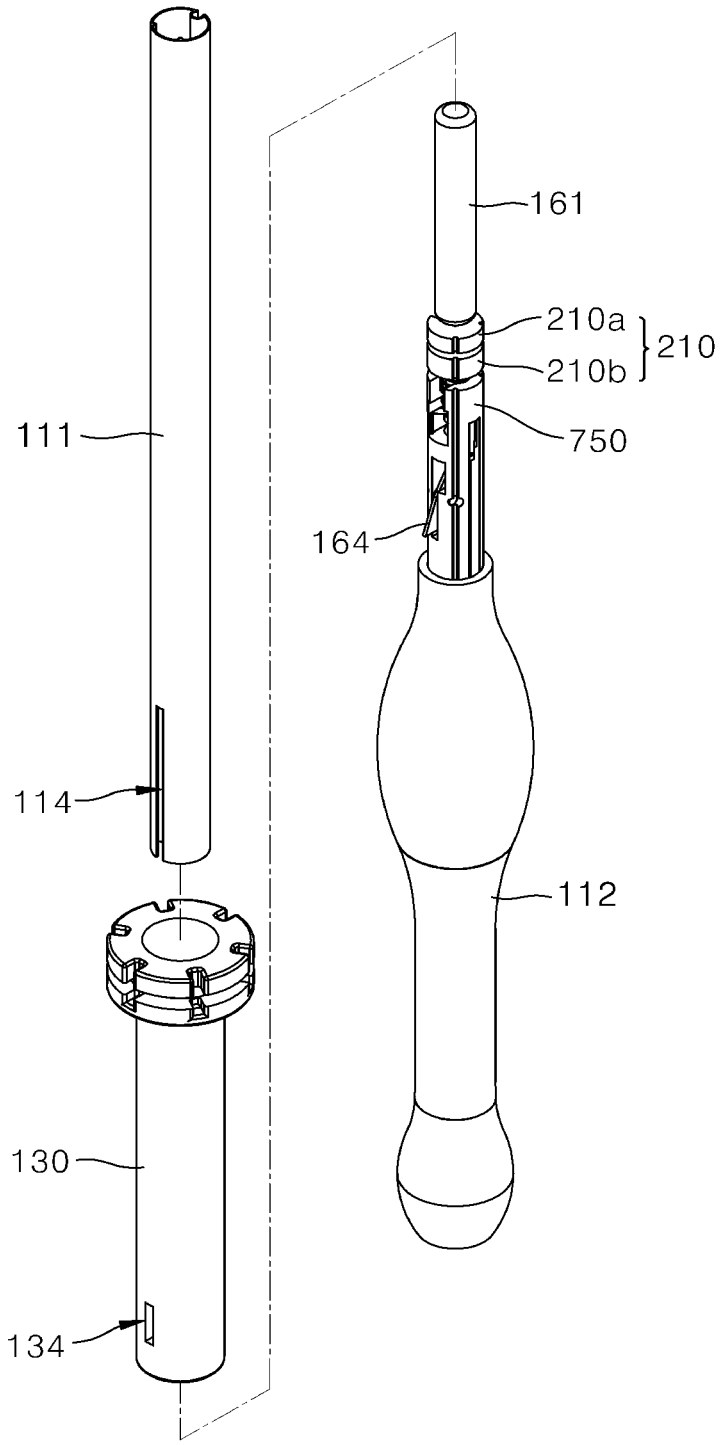
FIG. 13 is a separate-perspective view illustrating an umbrella shaft and an elevating body shown in FIG. 12 separated from each other.
Figure 14:
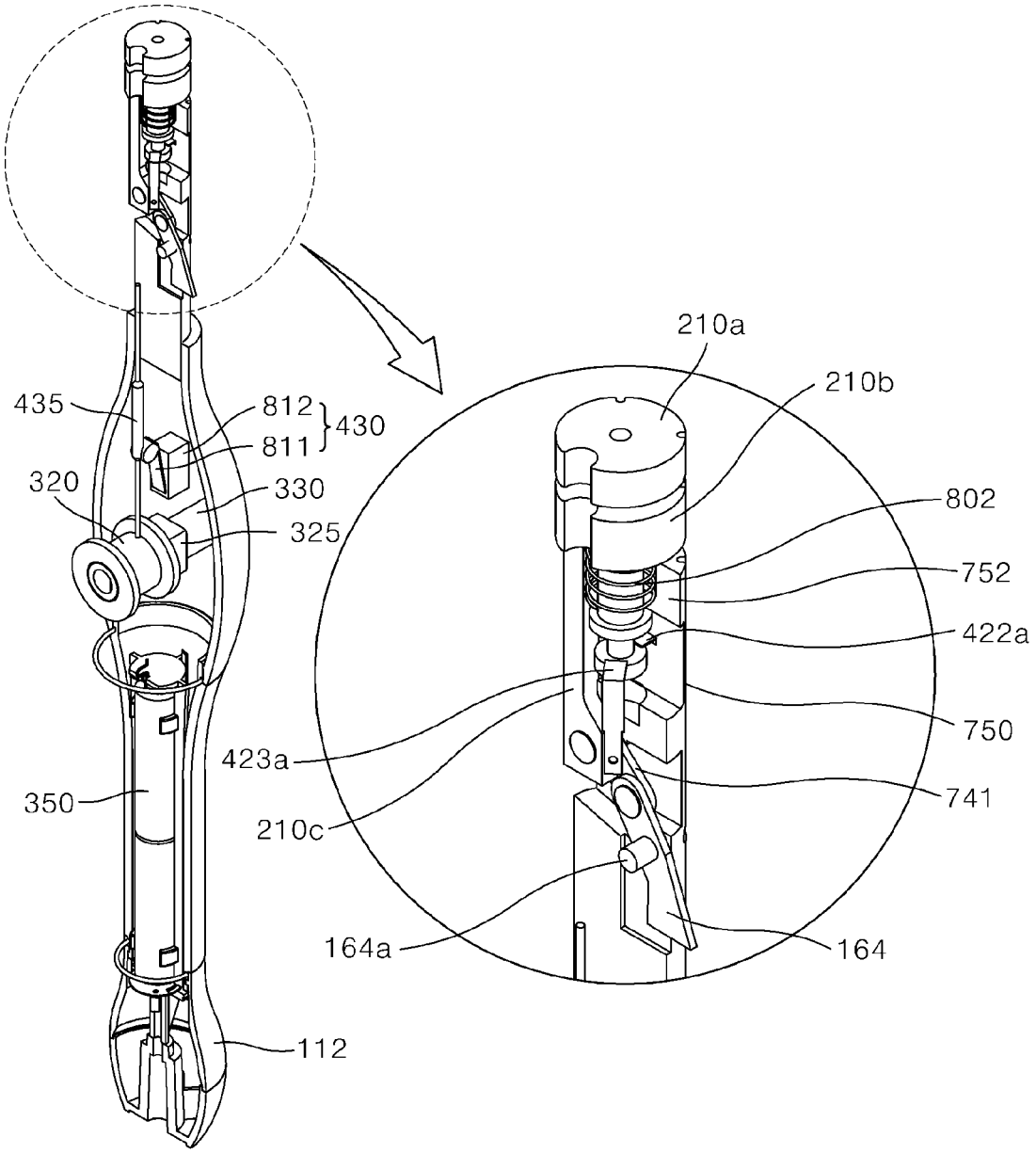
FIG. 14 is a cross-sectional perspective view illustrating a supporting housing and a grip portion of FIG. 13.
Figure 15:
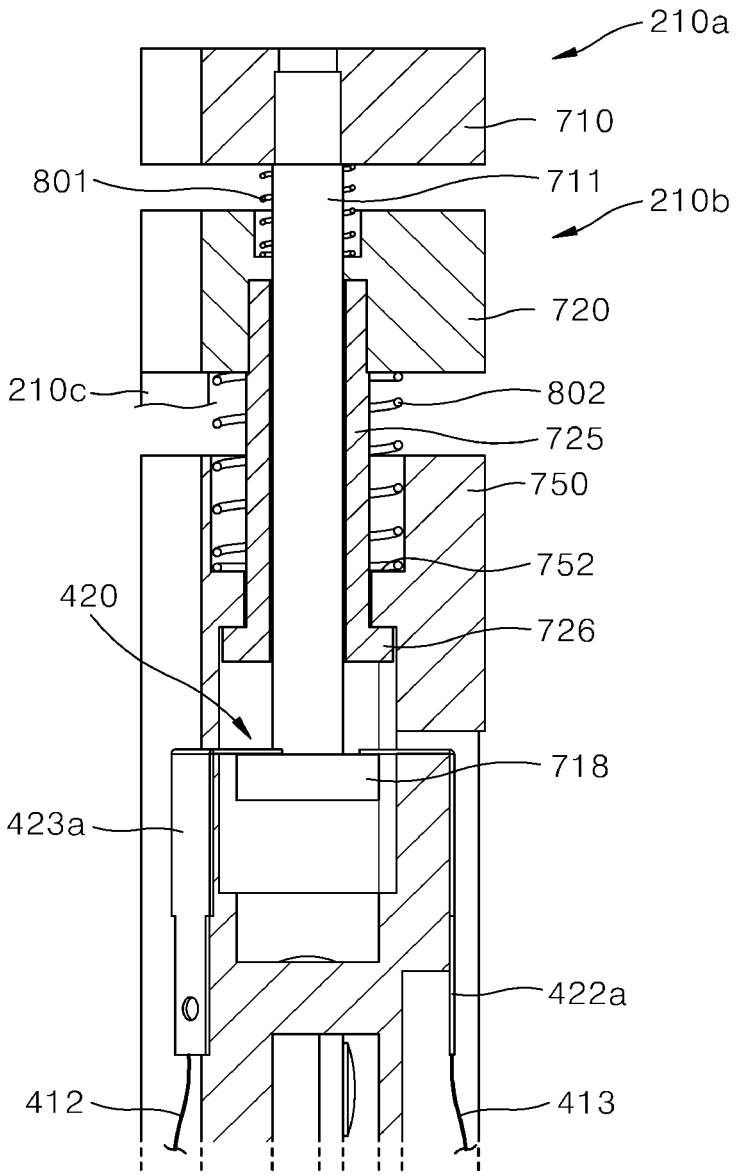
FIG. 15 is a cross-sectional view illustrating an operation process of first and second contact panels of FIG. 14.

Meanwhile, FIG. 9 illustrates a third contact plate 530 and a fourth contact plate 540 according to another embodiment of the present invention.

Referring to FIG. 9, the third contact plate 530 is fixed to the second fixed plate 431, and the fourth contact plate 540 is installed at the second fixed plate 431 to allow one end adjacent to the inner surface of the grip portion 112 to be pivotable. Also, the third and fourth contact plates 530 and 540 are processed to allow edges of one side adjacent to the inner surface of the grip portion 112 to be beveled to prevent interference while pivoting.

Also, a second interference member 531 is installed at the other end of the third contact plate 530 to prevent the fourth contact plate 540 from being separated from the second fixed plate 431. One end of the second interference member 531 is fixed to a top surface of the other end of the third contact plate 530, and the other end extends toward the fourth contact plate 540.

Here, the third contact plate 530 includes an insulating coating layer (not shown) which is formed to prevent an area from the third connection hole 437 to one end of a side facing the fourth contact plate 540 from conducting electricity. Also, the fourth contact plate 540 includes an insulating coating layer (not shown) which is formed to prevent an area from the fourth connection hole 438 to one end on a side facing the third contact plate 530 from being electrified.

The separation member 435 is installed at the elevating wire 310 and is inserted into the grip portion 112 through the insertion hole 116 and inserted into a gap between the third and fourth contact plates 432 and 433 when the elevating wire 310 is wound on the winding roller 320.

The elevating wire 310 is wound due to rotation of the winding roller 320 and moves toward the one end of the main rod 111. Here, when the other end of the restriction protrusion 164 enters the restriction groove 134 of the lower rib cylinder 132, the separation member 435 is inserted into the gap between the third and fourth contact plates 432 and 433 and is fixed to a position, on the elevating wire 310, adjacent to the elevating body 130 to cut off power supplied to the rotating motor 330. That is, the separation member 435 is fixed to the elevating wire 310 at a position separated from one end of the elevating wire 310 by a distance corresponding to a vertical distance from the third and fourth contact plates 432 and 433 to the other end of the restriction protrusion 164.

Here, the separation member 435 may have a hemispherical end to be easily inserted into the gap between the third and fourth contact plates 432 and 433.

The fourth elastic member 434 is installed at a second supporting plate 439 fixed to the second fixed plate 431 at a separated position in a direction of getting far away from the fourth contact plate 433 and may be a plate spring that is convex toward the fourth contact plate 433. One end of the fourth elastic member 434 is fixed to the second supporting plate 439, and the other end is movably coupled with the second supporting plate 439.

Meanwhile, the driving portion 162 may include a sub elastic portion 610 which is compressed by the elevating body 130 moving toward the one end of the main rod 111 and provides elastic force to the elevating body 130 to move toward the other end of the main rod 111, when the restriction protrusion 164 is separated from the restriction groove 134 of the elevating body 130.

The sub elastic portion 610 includes a supporting ring 611 including a hollow to allow the main rod 111 to pass through and a supporting spring 612 which includes one end fixed to the supporting ring 611 and the other end fixed to the grip portion 112 and provides elastic force to move the supporting ring 611 to the other end of the main rod 111.

The supporting ring 611 includes a through groove which is formed in an annular shape along an outer circumferential surface of the main rod 111 at a position facing the through groove 114 of the main rod 111 and penetrates along the longitudinal direction of the main rod 111 to allow an end portion of the restriction protrusion 164 which protrudes outward from the main rod 111 through the through groove 114. The supporting spring 612 may be a coil spring wound multiple times on the outer circumferential surface of the main rod 111.

The supporting spring 612 is compressed by the elevating body 130 which moves toward the one end of the main rod 111 to allow the end portion of the restriction protrusion 164 to be inserted into the restriction groove 134. When the restriction protrusion 164 is separated from the restriction groove 134 of the elevating body 130, the supporting spring 612 extends due to elastic force and moves the elevating body 130 to the other end of the main rod 111.

An operation of the automatic umbrella 100 according to one embodiment of the present invention configured as described above will be described in detail as follows.

First, when unfolding the umbrella canvas 150, the umbrella shaft 110 is tilted to allow the other end of the main rod 111 to be above the one end. In this case, the weight portion 161 inside the main rod 111 moves downward along the main rod 111 and collides with the contact panel 210. Here, the contact panel 210 moves downward due to a collision with the weight portion 161 and the pivoting force transfer portion 220 transfers movement force of the contact panel to the restriction protrusion 164. Due to the pivoting force transfer portion 220, the restriction protrusion 164 is inserted in the main rod 111 and pivots to be separated from the lower rib cylinder 132 of the elevating body 130, and the elevating body 130 is released from a restriction state with the umbrella shaft 110. The elevating body 130 which has been released from the restriction state unfolds the umbrella canvas 150 by rotating the main ribs 120 and the sub ribs 140, while moving upward along the main rod 111 due to elastic force of the first elastic member 163.

Here, the interconnection protrusion 425 moves downward together with the contact panel 210 and is inserted into a gap between the first and second contact plates 422 and 423. The first and second contact plates 422 and 423 are separated from each other by the interconnection protrusion 425 and cuts off power supplied to the rotating motor 330.

When folding the umbrella canvas 150, the umbrella shaft 110 is tilted to allow the other end of the main rod 111 to be below the one end. In this case, the weight portion 161 inside the main rod 111 moves toward the other end of the main rod 111 and is separated from the contact panel 210. The contact panel 210 moves toward the other end of the main rod 111 due to the second elastic member 421*a*, and the interconnection protrusion 425 is separated from the first and second contact plates 422 and 423 due to the contact panel 210. When the interconnection protrusion 425 is separated, the first and second contact plates 422 and 423 get in contact with each other due to elastic force, and the power of the battery 350 is supplied to the rotating motor 330 through the power line 410. The rotating motor 330 winds the elevating wire 310 by rotating the winding roller 320 through the torque transfer portion 340.

The elevating body 130 moves toward the one end of the main rod 111 due to the elevating wire 310 wound on the winding roller 320, and the main ribs 120 and the supporting ribs 133 pivot toward the main rod 111, thereby folding the umbrella canvas 150. Here, when the elevating body 130 moves to allow the restriction protrusion 164 to enter the restriction groove 134 of the lower rib cylinder 132, the separation member 435 fixed to the elevating wire 310 is inserted into the gap between the third and fourth contact plates 432 and 433 and separates the third and fourth contact plates 432 and 433 from each other. When the third and fourth contact plates 432 and 433 are separated from each other, power supplied to the rotating motor 330 is cut off and the rotating motor 330 stops.

As described above, since the umbrella canvas 150 is folded when the end is tilted downward by the operation unit 160 and is unfolded when the end is tilted upward, the automatic umbrella 100 according to the embodiment of the present invention may allow a golfer to easily operate the umbrella 100 during a golf game and to further concentrate on the golf game.

Meanwhile, a structure of a driving portion according to another embodiment of the present invention will be described with reference to FIGS. 12 to 16. Elements which perform the same function as shown in the previous drawings will be referred by the same reference numerals.

The main rod 111 of the umbrella shaft 110 includes a wire accommodating groove 111*a* which is formed in a hollow cylindrical shape along a longitudinal direction, includes the moving path 113, is inserted inward while the outer diameter getting smaller, and extends along the longitudinal direction on the outer circumferential surface to accommodate the elevating wire 310 and the separation member 435 and rotation suppression rails 111*b* which protrudes toward inside of the accommodating groove 111*a* and the moving path 113 and separated from each other. Here, an extension length of the wire accommodating groove 111*a* does not extend according to the total length of the umbrella shaft 110 but may be formed as having a properly limited length considering movement ranges of the elevating body 130 and the elevating wire 310.

Also, the rotation suppression rails 111*b* may also be formed without areas beyond movement ranges of the sliding elements including first and second contact plates 210*a* and 210*b*.

Meanwhile, the contact panel 210 of the restriction control portion 165 includes the first and second contact panels 210*a* and 210*b*.

The first contact panel 210*a* has a structure including a first disk portion 710 which is formed in a disk shape, restricted by the rotation suppression rails 111*b* and a protruding area of the wire accommodating groove 111*a* to be slidable inside the umbrella shaft 110, a forward-backward movement bar 711 extending downward from a center of a bottom surface of the first disk portion 710, and a conductive guide ring 718 formed with outer diameter which is increasing at a terminal end of the forward-backward movement bar 711.

Here, the conductive guide ring 718 is coated with a conducting material at least at a top surface thereof to support conduction through contact with first and second electrode terminals 422*a* and 423*a*, which will be described below.

A restriction sliding groove corresponding to the wire accommodating groove 111*a* and the rotation suppression rails 111*b* is formed on an outer circumferential surface of the first disk portion 710 of the first contact panel 210*a*.

The second contact panel 210*b* is disposed below the first contact panel 210*a* along the longitudinal direction of the umbrella shaft 110.

The second contact panel 210*b* has a structure including a second disk portion 720 which is formed in a disk shape to be restricted by the rotation suppression rails 111*b* and the protruding area of the wire accommodating groove 111*a* and slidable inside the umbrella shaft 110, a sleeve pipe 725 formed with a through hole to allow the forward-backward movement bar 711 to be inserted therein while passing through the center of a top surface to a bottom end of the second disk portion 720, and a separation prevention protrusion 726 which is formed below the sleeve pipe 725 and has an outer diameter further extending than the sleeve pipe 725.

Also, an extension rod 210*c* which extends downward from an edge of an outer circumferential surface of the second disk portion 720 of the second contact panel 210*b* and is coupled with a link member 741, which will be described below, is formed.

A first spring 801 is installed between a bottom portion of the first disk portion 710 of the first contact panel 210*a* and a top portion of the second disk portion 720 of the second contact panel 210*b* and provides elastic force to allow the first disk portion 710 to be far away from the second disk portion 720.

A second spring 802 is installed between a mounting step 752 of a supporting housing 750 and a bottom surface of the second disk portion 720 of the second contact panel 210*b* and provides elastic force in the direction of the second contact panel 210*b* getting farther away from the supporting housing 750.

Here, the second spring 802 corresponds to a second elastic member.

The supporting housing 750 may be installed below the second disk portion 720 of the second contact panel 210*b* and may support and accommodate the second spring 802.

The supporting housing 750 supports the second spring 802 in a mounted state and provides a mounting area to support and mount the first and second electrode terminals 422*a* and 423*a* corresponding to a first switching portion.

Here, the second sub line 413 is connected to the first electrode terminal 422*a*, and the third sub line 412 is connected to the second electrode terminal 423*a*. The supporting housing 750 is installed in and fixed to the main rod 111, supports and accommodates the second spring 802, and rotatably supports a hinge 164*a* of the restriction protrusion 164.

The first and second electrode terminals 422*a* and 423*a*, which are mounted in the supporting housing 750 to be separated from each other and may be connected to or separated from the second sub line 413 and the third sub line 412 due to contact and separation with the conductive guide ring 718, are applied to the first switching portion 420.

A contact switch, which is interfered with or released from interference by the separation member 435 to turn on or off a switch contact point, is applied to the second switching portion 430. In this case, a switch piece 811 of the contact switch applied to the second switching portion 430 is connected to a second sub line 413 and a body 812 of the contact switch is connected to a first sub line 414.

The restriction protrusion 164 is installed to be pivotable by the hinge 164*a* supported by the supporting housing 750, and the link member 741 is connected between a top end of the restriction protrusion 164 above the hinge 164*a* and the extension rod 210*c*.

The torque of the rotating motor 330 is transferred to the winding roller 320 through a clutch portion 325.

The clutch portion 325 binds the winding roller 320 with the rotating motor 330 for power transmission to allow the winding roller 320 to rotate in a direction of winding the elevating wire 310 when the rotating motor 330 is rotated by supplied power.

Also, the clutch portion 325 releases binding between the winding roller 320 and the rotating motor 330 to allow the winding roller 320 to rotate in a direction of unwinding the elevating wire 310 when the power supplied to the rotating motor 330 is cut off or the rotating motor 330 is not rotated.

The clutch portion 325 described above may employ a publicly known mechanical or electronic structure.

Meanwhile, in the structure of the driving portion described above, the first spring 801 which is applied has an elastic coefficient relatively small compared to that of the second spring 802.

That is, even only with the weight portion 161 in a state of maintaining contact to apply weight to the first disk portion 710 of the first contact panel 210*a*, the first spring 801 is compressed and the forward-backward movement bar 711 moves downward, thereby electrically separating the first and second electrode terminals 422*a* and 423*a* of the first switching portion 420 from each other. As described above, since the second spring 802 may not be compressed while the weight portion 161 is in contact with the first contact panel 210*a* to apply a load, the weight portion 161 allows the restriction protrusion 164 to pivot only when a great shock capable of compressing the second spring 802 is applied, thereby strengthening a shock strength requirement for releasing restriction of the elevating body 130 on the restriction protrusion 164.

Meanwhile, when the weight portion 161 comes into contact with the first contact panel 210*a* with the shock capable of compressing the second spring 802, the first contact panel 210*a* and the second contact panel 210*b* move back together, and in this process the first switching portion 420 is electrically turned off and additionally the extension rod 210*c* moves downward and rotates to separate the restriction protrusion 164 from the restriction groove 134 of the elevating body 130. A process of unfolding and folding the umbrella canvas 150 when the weight portion 161 comes into contact with the second contact panel 210*b* with a shock capable of moving the second contact panel 210*b* and is separated therefrom is identical to the operation process described above.

Figure 16:
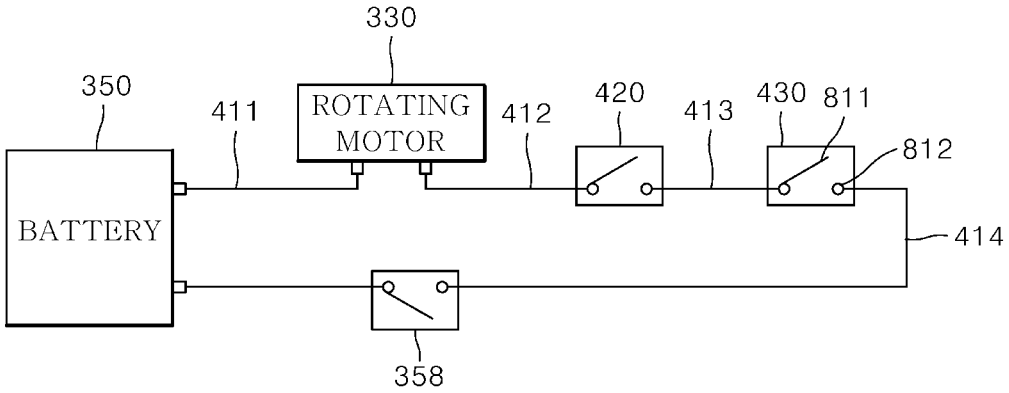
FIG. 16 is a circuit diagram of a control system of a rotating motor of FIG. 14.

Meanwhile, as shown in FIG. 16, a main switch 358 may be provided at the grip portion 112, which cuts off power supplied from the battery 350 to the rotating motor 330 regardless of operations of the first switching portion 420 and the second switching portion 430.

In this case, with respect to a change in tilting of the umbrella shaft 110, when a folding operation of the umbrella canvas 150 is not necessary, the main switch 358 is operated to be in an off state.

Since the umbrella canvas is folded when the end tilts upward due to the operation unit and is unfolded when the end tilts upward, the automatic umbrella allows a golfer to easily operate during a golf game to further concentrate on the golf game. Also, even in the case of a person who carries luggage with one hand or a disabled person who has difficulty moving one of the arms, it is easy to fold or unfold the umbrella canvas by tilting an umbrella shaft.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An automatic umbrella comprising:

an umbrella shaft which comprises a grip portion for allowing a user to grip, at one end according to a longitudinal direction;

a plurality of main ribs pivotably coupled with the other end of the umbrella shaft and spaced apart along a circumferential direction of the umbrella shaft;

an elevating body slidably installed at the umbrella shaft along the longitudinal direction;

a plurality of sub ribs pivotably coupled between the main ribs and the elevating body;

umbrella canvas coupled with the main ribs; and an operation unit which moves the elevating body to the other end of the umbrella shaft to unfold the umbrella shaft when the umbrella shaft tilts to locate the other end to be above the one end of the umbrella shaft and moves the elevating body to the one end of the umbrella shaft to fold the umbrella shaft when the umbrella shaft tilts to locate the one end to be above the other end of the umbrella shaft wherein the operation unit comprises:

a weight portion which is installed at the umbrella shaft to be slidable along the longitudinal direction and has a weight to be moved along a direction in which the umbrella shaft tilts; and a driving portion moves the elevating body toward the one end of the umbrella shaft to fold the umbrella shaft when the weight portion becomes adjacent to the other end of the umbrella shaft and moves the elevating body toward the other end of the umbrella shaft when the weight portion is moved toward the one end of the umbrella shaft.

2. The automatic umbrella of claim 1, wherein the elevating body comprises a restriction groove at an outer circumferential surface, and wherein the driving portion comprises:

a first elastic member which is installed at the umbrella shaft and provides elastic force to move the elevating body toward the other end of the umbrella shaft;

restriction protrusions pivotably installed at the one end of the umbrella shaft to be inserted into the restriction groove of the elevating body to restrict the elevating body to the umbrella shaft when the elevating body is positioned at the one end of the umbrella shaft;

a restriction control portion which is installed at the one end of the umbrella shaft on a moving path of the weight portion and separates the restriction protrusions from the restriction groove to release restriction state of the elevating body with the umbrella shaft while being in contact with the weight portion; and an elevating control portion which moves the elevating body toward the one end of the umbrella shaft when the weight portion is separated from the restriction control portion.

3. The automatic umbrella of claim 2, wherein the restriction control portion comprises:

a contact panel which is installed at the umbrella shaft on the moving path of the weight portion at a position corresponding to the one end of the umbrella shaft and moves to the one end of the umbrella shaft from the other end when the weight portion collides;

a pivoting force transfer portion which is installed between the contact panel and the restriction protrusions and allows the restriction protrusions to pivot to separate the restriction protrusions from the restriction groove of the elevating body when the weight portion collides and the contact panel moves to the one end of the umbrella shaft from the other end; and a second elastic member which provides elastic force to allow the restriction protrusions to protrude outward from an outer circumferential surface of the umbrella shaft to allow the restriction protrusions to enter the restriction groove of the elevating body.

4. The automatic umbrella of claim 3, wherein the elevating control portion comprises:

an elevating wire with one end fixed to the elevating body;

a winding roller rotatably installed at the one end of the umbrella shaft to allow the other end of the elevating wire to be coupled and winding of the elevating wire;

a rotating motor which is installed at the umbrella shaft and generates torque;

a torque transfer portion which transfers the torque of the rotating motor to the winding roller;

a battery installed at the umbrella shaft to supply power to the rotating motor; and a control portion which transfers power of the battery to the rotating motor to allow the winding roller to rotate to allow the elevating body to move to the one end of the umbrella shaft when the weight portion is separated from the contact panel and cuts off power supplied to the rotating motor to unwind the elevating wire from the winding roller when the weight portion is in contact with the contact panel.

5. The automatic umbrella of claim 4, wherein the control portion comprises a first switching portion which is connected in series on a power line for supplying power from the battery to the rotating motor and opens the power line by interlocking with the contact panel to cut off the power supplied to the rotating motor when the contact panel moves toward the one end of the umbrella shaft due to colliding with the weight portion.

6. The automatic umbrella of claim 5, wherein the first switching portion comprises:

a first fixed plate fixed to the umbrella shaft at a position separated from the other surface of the contact panel opposite to one surface of the contact panel facing the weight portion in a direction to one end of the umbrella shaft from the other end;

first and second contact plates which are installed at the first fixed plate at a position facing the other surface of the contact panel to be separable and combinable with each other, supplies the power of the battery to the rotating motor through the power line when connected to the power line and coupled, and cuts off the power supplied through the power line when separated;

a third elastic member which provides elastic force to couple the first and second contact plates with each other; and an interconnection protrusion which is fixed to the other surface of the contact panel at a position facing contact surfaces of the first and second contact plates and is an insulator inserted into a gap between the first and second contact plates to separate the first and second contact plates from each other to cut off the power supplied to the rotating motor when the contact panel moves due to colliding with the weight portion.

7. The automatic umbrella of claim 2, wherein the driving portion further comprises a sub elastic portion which is compressed by the elevating body moving toward the one end of the umbrella shaft and provides elastic force to allow the elevating body to move to the other end of the umbrella shaft when the restriction protrusions are separated from the restriction groove.

8. The automatic umbrella of claim 5, wherein the control portion further comprises a second switching portion which is connected to the first switching portion in series on the power line for supplying the power from the battery to the rotating motor and opens the power line to cut off the power supplied to the rotating motor when the restriction protrusions enter the restriction groove of the elevating body and the elevating body is restricted by the umbrella shaft.

9. The automatic umbrella of claim 8, wherein the second switching portion comprises:

a second fixed plate which is installed at the umbrella shaft and comprises a through hole through which the elevating wire is allowed to pass;

third and fourth contact plates which are installed at the second fixed plate to be adjacent or separated from each other based on the elevating wire, supply the power of the battery to the rotating motor through the power line when connected to the power line and in contact with each other, and cut off the power supplied through the power line when separated from each other;

a fourth elastic member which provides elastic force to couple the third and fourth contact plates with each other; and a separation member which is fixed to the elevating wire and is an insulator inserted into a gap between the third and fourth contact plates to separate the third and fourth contact plates from each other when the elevating body moves to the one end of the umbrella shaft to allow the restriction protrusions to enter the restriction groove.

10. The automatic umbrella of claim 6, wherein the second elastic member is installed between the first fixed plate and the contact panel and provides elastic force to separate the contact panel from the first fixed plate, the automatic umbrella further comprising at least one restriction protrusion which is installed at the first fixed plate and protrudes in a direction of getting closer to the contact panel to restrict a movement distance of the contact panel when the contact panel moves due to colliding with the weight portion.

11. The automatic umbrella of claim 6, wherein the first fixed plate comprises an inducing groove that is penetrating in a movement direction of the contact panel, wherein the contact panel comprises an inducing protrusion extending toward to the one end of the umbrella shaft to allow an end to be inserted and penetrate the inducing groove, and wherein a separation prevention protrusion which is formed bent from the inducing protrusion is formed at the end of the inducing protrusion to prevent the inducing protrusion from being separated from the first fixed plate when the contact panel moves from the first fixed plate toward the other end of the umbrella shaft.

12. The automatic umbrella of claim 4, wherein the contact panel comprises:

a first contact panel which is installed on the moving path of the weight portion at a position corresponding to the one end of the umbrella shaft to move to the one end of the umbrella shaft from the other end when the weight portion collides;

a second contact panel which is installed at the umbrella shaft to face the first contact panel in the rear of the first contact panel along a direction which faces the one end of the umbrella shaft; and a first spring installed between the first contact panel and the second contact panel, wherein the second elastic member employs a second spring which is installed between a mounting step formed at a supporting housing installed to be fixed to the rear of the second contact panel toward the one end of the umbrella shaft with respect to the second contact panel and pivotably supports the restriction protrusions and the second contact panel to elastically bias the second contact panel upward, and wherein the pivoting force transfer portion is coupled between the second contact panel and the restriction protrusions to allow the restriction protrusions to pivot and be separated from the restriction groove when the second contact panel moves toward the one end of the umbrella shaft from the other end due to a shock applied by the weight portion colliding with the first contact panel.

13. The automatic umbrella of claim 12, wherein the control portion comprises a first switching portion which is connected in series on a power line for supplying power from the battery to the rotating motor and opens the power line by interlocking with the first contact panel to cut off the power supplied to the rotating motor when the first contact panel moves toward the one end of the umbrella shaft due to colliding with the weight portion.

14. The automatic umbrella of claim 4, wherein a wire accommodating groove which is inserted inward and extends along a longitudinal direction to accommodate the elevating wire is formed at the outer circumferential surface of the umbrella shaft.

* * * * *